US011447325B2

(12) United States Patent
Tavakoli et al.

(10) Patent No.: US 11,447,325 B2
(45) Date of Patent: Sep. 20, 2022

(54) CONTAINER WITH THERMALLY INSULATED COMPARTMENTS

(71) Applicants: Sara Tavakoli, Lake Worth, FL (US); Ryan Tavakoli, Lake Worth, FL (US)

(72) Inventors: Sara Tavakoli, Lake Worth, FL (US); Ryan Tavakoli, Lake Worth, FL (US)

(73) Assignee: Sara Tavakoli, North Palm Beach, FL (US)

( * ) Notice: Subject to any disclaimer, the term of this patent is extended or adjusted under 35 U.S.C. 154(b) by 0 days.

(21) Appl. No.: 16/378,251

(22) Filed: Apr. 8, 2019

(65) Prior Publication Data

US 2019/0308794 A1 Oct. 10, 2019

Related U.S. Application Data

(60) Provisional application No. 62/653,774, filed on Apr. 6, 2018.

(51) Int. Cl.

| | |
|---|---|
| ***B65D 81/38*** | (2006.01) |
| ***A45C 11/20*** | (2006.01) |
| ***B65D 43/02*** | (2006.01) |

(52) U.S. Cl.

CPC ..... *B65D 81/383* (2013.01); *A45C 11/20* (2013.01); *B65D 43/021* (2013.01); *B65D 81/3834* (2013.01); *B65D 2543/0099* (2013.01)

(58) Field of Classification Search

CPC .... A47G 19/02; A47G 19/027; B65D 81/383; B65D 81/3834; A45C 11/20

See application file for complete search history.

(56) References Cited

U.S. PATENT DOCUMENTS

| | | | | |
|---|---|---|---|---|
| 2,096,825 | A * | 10/1937 | Roman | A47G 19/02 426/114 |
| 4,499,998 | A | 2/1985 | Carlson | |
| 5,217,141 | A * | 6/1993 | Ross | A47G 19/2261 220/713 |
| 5,913,445 | A * | 6/1999 | Fujii | A47J 41/0077 220/574 |
| 6,131,760 | A | 10/2000 | Huang | |
| 6,276,162 | B1 | 8/2001 | Schemel | |
| 7,326,428 | B2 | 2/2008 | Weir | |
| 7,793,799 | B2 * | 9/2010 | Reggiani | B65D 83/68 222/135 |
| 9,340,334 | B2 | 5/2016 | Desiena | |
| 2002/0074259 | A1 * | 6/2002 | Gutierrez | A45C 11/20 206/545 |
| 2004/0262319 | A1 | 12/2004 | Fisher | |
| 2007/0256449 | A1 | 11/2007 | Torre | |
| 2012/0318808 | A1 * | 12/2012 | McCormick | F16L 59/065 220/592.21 |
| 2015/0245723 | A1 * | 9/2015 | Alexander | F25B 21/04 99/483 |
| 2015/0369529 | A1 | 12/2015 | Monroe | |

* cited by examiner

*Primary Examiner* — Andrew T Kirsch

(57) ABSTRACT

A food storage container includes two or more thermally insulated compartments that can facilitate storage of hot and cold items in a single container. The container includes sidewalls and interior walls that provide thermally insulated barriers. The container further includes a cover that also provides a thermally insulated barrier and securely complements each of the compartments within the container. The cover also includes a gasket or seal along its perimeter.

16 Claims, 7 Drawing Sheets

CONTAINER WITH THERMALLY INSULATED COMPARTMENTS

This application claims the benefit of U.S. Provisional Application No. 62/653,774 filed on Apr. 6, 2018.

BACKGROUND OF THE INVENTION

Field of the Invention

The present technology relates to the field of food storage containers.

Description of the Related Art

There are a great variety of containers for household use that are designed for the storage of foods or liquids. Moreover, many food storage containers are designed to thermally insulate the contents of the container in order to maintain a hot or cold temperature of the contents for a period of time. Containers such as coolers or thermoses can keep their contents either hot or cold, but do not have the ability to maintain the temperature for both hot and cold contents simultaneously.

Similarly, containers such as "bento-box" styled lunchboxes do not provide thermal insulation among their different compartments. That is, such containers are designed to store food items in the various compartments at substantially the same temperature—either all hot or all cold by utilizing a cold pack or an insulated bag that maintains the same desired temperature in the entire container and its various compartments within. If a user wishes to store both hot and cold food items, separate containers are needed.

Consequently, there is a need for a food storage container having compartments that are thermally insulated from each other. A container having two or more thermally insulated compartments can facilitate storage of hot and cold items within a single container.

BRIEF SUMMARY OF THE INVENTION

Embodiments of the present technology address deficiencies of the art in respect to food storage containers. The present technology permits storage of food items having different temperatures in a single container. The container can provide various compartments that are thermally insulated from each other to facilitate storage of hot items in a compartment that is adjacent to cold items.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the scope of the disclosure.

The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Figure 1:
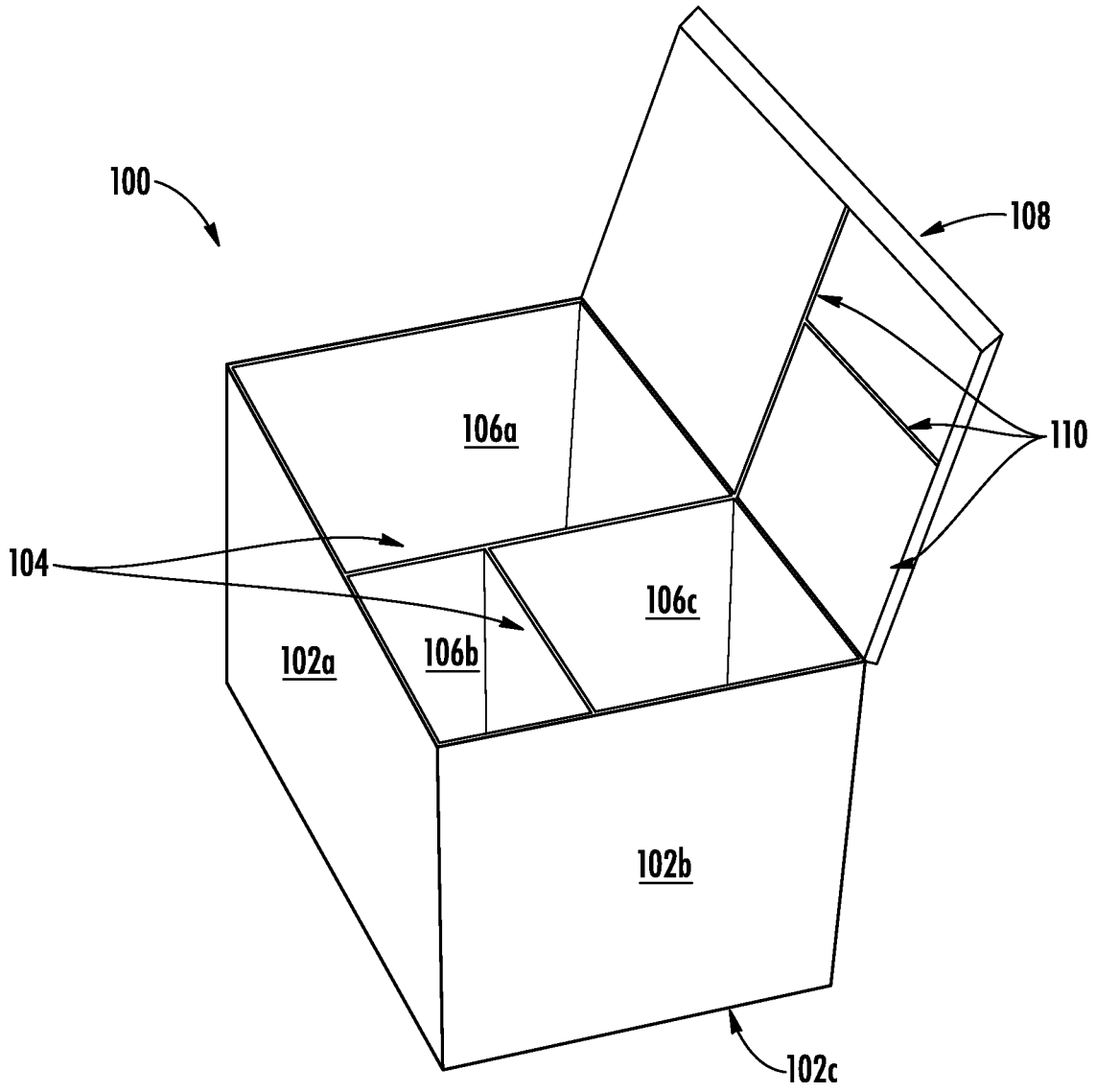
FIG. 1 illustrates a perspective view of a container having thermally insulated compartments.

FIG. 1 illustrates a perspective view of a container 100 in accordance with the present technology. Container 100 can have one or more sidewalls 102*a*, 102*b* and a bottom wall 102*c* that together define an interior volume of container 100. In one embodiment, sidewalls 102*a*, 102*b* and bottom wall 102*c* can have thermal and/or radiant energy transmission deterrence properties designed to maintain the temperature of items placed in the interior volume of container 100, whether elevated or reduced in relation to an ambient temperature external to the container 100.

For example, sidewalls 102*a*, 102*b* and bottom wall 102*c* can each include or consist of a double-wall vacuum insulated barrier that provides thermal insulation to the interior volume of container 100. Alternatively, sidewalls 102*a*, 102*b* and bottom wall 102*c* can each include a barrier that is infused with a thermally insulating material such as polyurethane foam or a material having similar properties. In another embodiment, sidewalls 102*a*, 102*b* and bottom wall 102*c* can be a single material having sufficient thickness to provide thermal insulation.

The interior volume of container 100 can be divided into one or more interior compartments 106*a*, 106*b*, 106*c* by one or more interior walls 104. Although container 100 is illustrated having three rectangular interior compartments 106*a*, 106*b*, 106*c*, those skilled in the art will recognize that the number of interior compartments and the shape of the interior compartments can be changed in accordance with the technology disclosed herein.

Interior walls 104 can have thermal and/or radiant energy transmission deterrence properties designed to provide thermal insulation between interior compartments 106*a*, 106*b*, and 106*c*. Thermal insulation provided by interior walls 104 can allow each interior compartment 106*a*, 106*b*, and 106*c* to maintain the temperature of items placed within the respective interior compartment, whether that temperature is elevated or reduced in relation to the temperature of an item placed in an adjacent interior compartment. Accordingly, interior compartments 106*a*, 106*b*, and 106*c* can be utilized to simultaneously maintain the temperature of both hot and cold food items within the container 100.

In one embodiment, each of interior walls 104 can be formed with the same construction as sidewalls 102*a*, 102*b* and bottom wall 102*c*. That is, interior walls 104 can include or consist of double-wall vacuum insulated barriers that provide thermal insulation between interior compartments 106*a*, 106*b*, and 106*c*. Alternatively, interior walls 104 can each include or consist of a barrier that is infused with a thermally insulating material such as polyurethane foam or a material having similar properties.

In one embodiment, interior walls 104, sidewalls 102*a*, 102*b*, and bottom wall 102*c* of container 100 are all formed as a single structure having a unitary construction. A unitary arrangement for container 100 can provide a stable configuration for hot and cold items. For example, hot soup can be stored in same container as a cold salad while the items keep their respective temperatures and do not interfere with each other, and without the need to have another container with a separate lid that has to be attached to or incorporated with the primary container.

Container 100 can also include a lid or cover 108. Cover 108 can facilitate opening and closing a top portion of container 100 and provide protection and insulation to each of compartments 106*a*, 106*b*, and 106*c*. In one embodiment, cover 108 can be attached to the base portion of container 100 by way of a hinge or some other mechanical member that facilitates movement between open and closed positions for cover 108. In another embodiment, cover 108 can be a separate structure that is detached from the base portion to open container 100 and is attached for closing container 100. A single lid or cover 108 for container 100 is advantageous because it can be opened or removed in a manner that provides access to all items simultaneously and therefore avoids risk of spills caused by having to remove additional covers and/or detach/re-attach other compartments.

Cover 108 can be secured in a closed position by components such as clips, zippers, latches, clasps, fasteners, tongue/groove, or some other mechanical component(s) providing similar functionality. In some embodiments, cover 108 can include one or more handles to facilitate opening and closing cover 108 and/or to facilitate carrying container 100 when cover 108 is in a closed position. Alternatively, one or more handles can also be placed on the exterior portion of one or more of sidewalls 102*a*, 102*b*.

Cover 108 can be constructed to provide thermal insulation in order to maintain the temperature of items placed in the interior volume of container 100. For example, cover 108 can be constructed of a double-wall vacuum insulated barrier that provides thermal insulation to the interior volume of container 100. Alternatively, cover 108 can include or consist of a barrier that is infused with a thermally insulating material such as polyurethane foam or a material having similar properties.

Cover 108 can include one or more channels or grooves 110 configured for engagement with the top peripheral portion of sidewalls 102*a*, 102*b* or interior walls 104. In some embodiments, grooves 110 can be configured to include a gasket or seal for mating between cover 108 and sidewalls 102*a*, 102*b* as well as interior walls 104. The gasket or seal displaced along grooves 110 can be configured to prevent leakage of fluid among or between internal compartments 106*a*, 106*b*, 106*c* as well as preventing leakage of fluid to the outside of container 100.

Container 100 can be constructed from one or more materials suitable for providing thermal insulation among internal compartments 106*a*, 106*b*, and 106*c* as well as thermal insulation from ambient temperature, as described herein. For example, container 100 can be constructed from metal or a metal alloy such as stainless steel, plastic materials, or a combination thereof.

Figure 2:
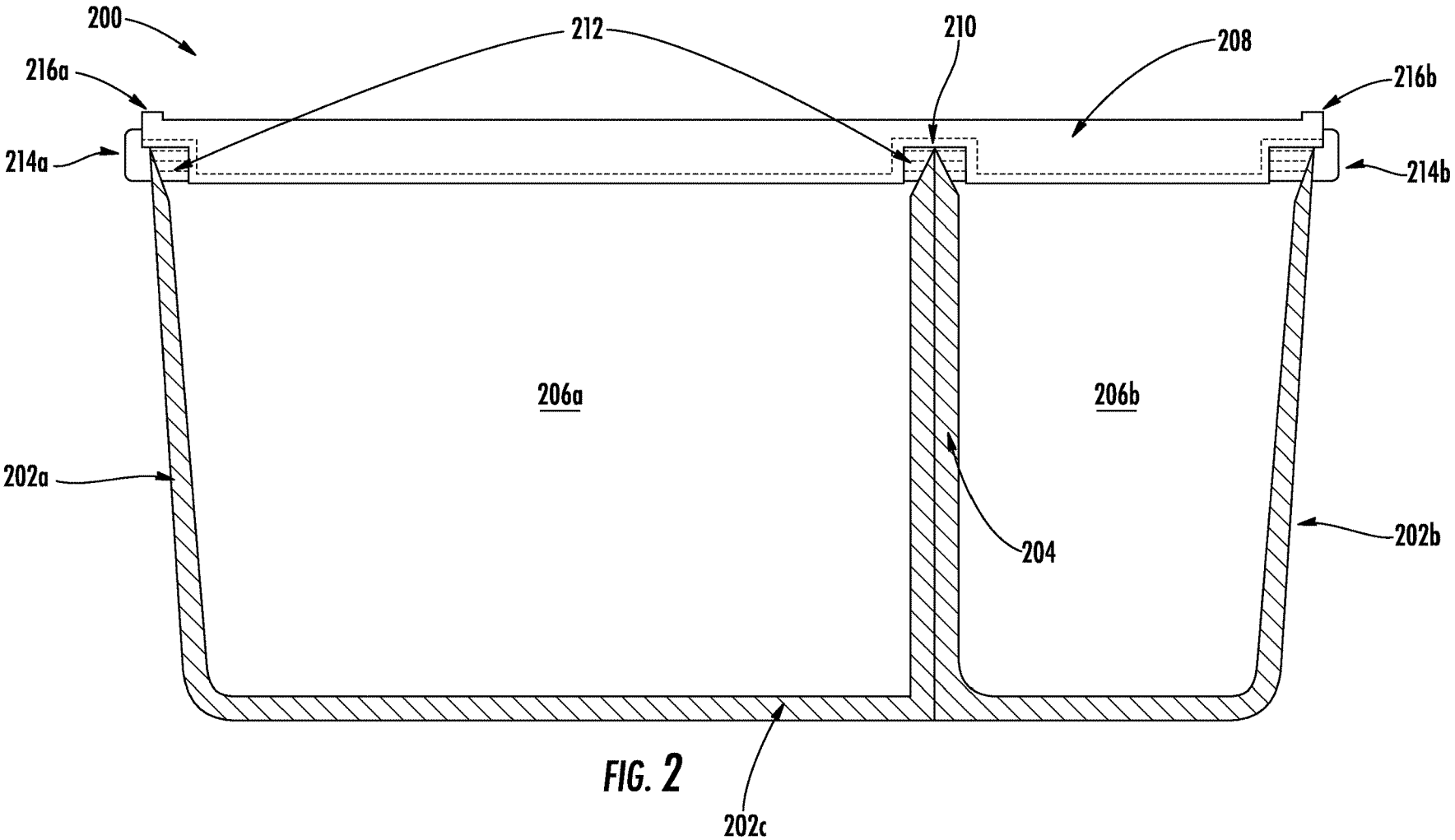
FIG. 2 illustrates a cross-sectional view of a container having thermally insulated compartments.

FIG. 2 illustrates a cross-sectional view of a container 200 in accordance with the present technology. As set forth with respect to the embodiment shown in FIG. 1 above, container 200 can have sidewalls 202*a*, 202*b* and bottom wall 202*c* that together define an interior volume. The interior volume can be divided into separate internal compartments 206*a*, 206*b* by one or more interior walls 204. Each of sidewalls 202*a*, 202*b*, bottom wall 202*c*, and interior wall 204 can be designed to provide thermal insulation.

As illustrated, interior wall 204 includes two vacuum insulated barriers that are adjacent to one another. Alternative embodiments having interior wall 204 with different numbers or types of thermal barriers are also contemplated herein. Similarly, as illustrated in FIG. 2, sidewalls 202*a*, 202*b*, and bottom wall 202*c* each include a single vacuum insulated barrier. Alternative embodiments having sidewalls 202*a*, 202*b*, and bottom wall 202*c* with different numbers or types of thermal barriers are also contemplated herein.

Container 200 can also have lid or cover 208 that can be configured to open and close container 200. Cover 208 can include one or more channels or grooves 210 that can have a seal or gasket 212 displaced within. Grooves 210 can be designed to align with the top of sidewalls 202*a*, 202*b* and also with the top of interior wall 204 such that when cover 208 is in a closed position gasket 212 provides a leak-proof seal to each of interior compartments 206*a*, 206*b*. The shape of grooves 210 can be designed to complement the shape of the top of sidewalls 202*a*, 202*b* and interior wall 202.

Cover 208 can be securely fastened in the closed position by using clips 214*a*, 214*b*. Other mechanical components providing similar functionality can be used in alternative embodiments. Cover 208 can also be designed to have a top surface that complements the bottom of container 200. For example, some embodiments of cover 208 may include one or more protrusions 216*a*, 216*b* designed to facilitate stacking of one or more containers 200. That is, the dimensions or area of bottom wall 202*c* can be designed to fit on top of cover 208 and protrusions 216*a*, 216*b* can keep the stacked container from slipping or falling away.

Figure 3:
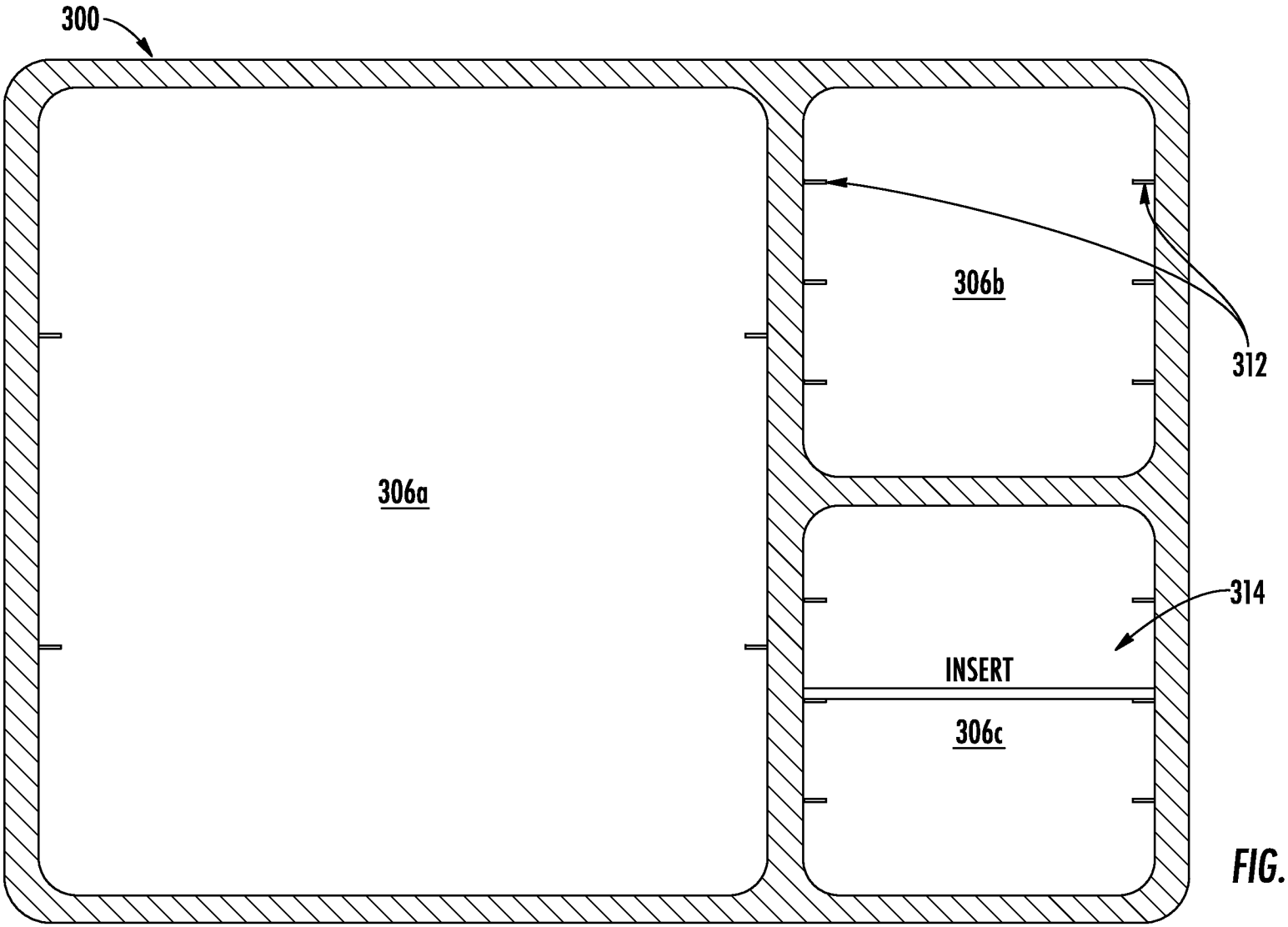
FIG. 3 illustrates a top view of a container having thermally insulated compartments.

FIG. 3 illustrates a top view of a container 300 in accordance with the present technology. As set forth with respect to the embodiments shown in FIGS. 1 and 2 above, container 300 can have one or more sidewalls and one or more interior walls that can divide the interior volume into two or more interior compartments 306*a*, 306*b*, and 306*c*. Interior compartments 306*a*, 306*b*, and 306*c* can be thermally insulated from each other to allow storage of hot and cold food items in adjacent compartments.

In some embodiments, interior compartments 306*a*, 306*b*, and 306*c* can include one or more protrusions 312 configured to receive one or more removable inserts 314. Removable insert 314 can be used to provide one or more barriers within interior compartments 306*a*, 306*b*, and 306*c*. For example, removable insert 314 can be used to keep two food items that are stored within the same interior compartment from touching or mixing with each other. In some embodiments, removable insert 314 can be positioned to create the area for a standard soda can and keep it from rolling around within the interior compartment 306*c*.

In some embodiments, protrusions 312 can be configured as recessed channels within each of compartments 306*a*, 306*b*, 306*c*. Removable insert 314 can have a corresponding length that is slightly longer than the width of its respective compartment such that it is secured within the recessed channels. In some embodiments, removable insert 314 can be configured to traverse its respective interior compartment in any direction; e.g. horizontal or vertical position.

Figure 4:
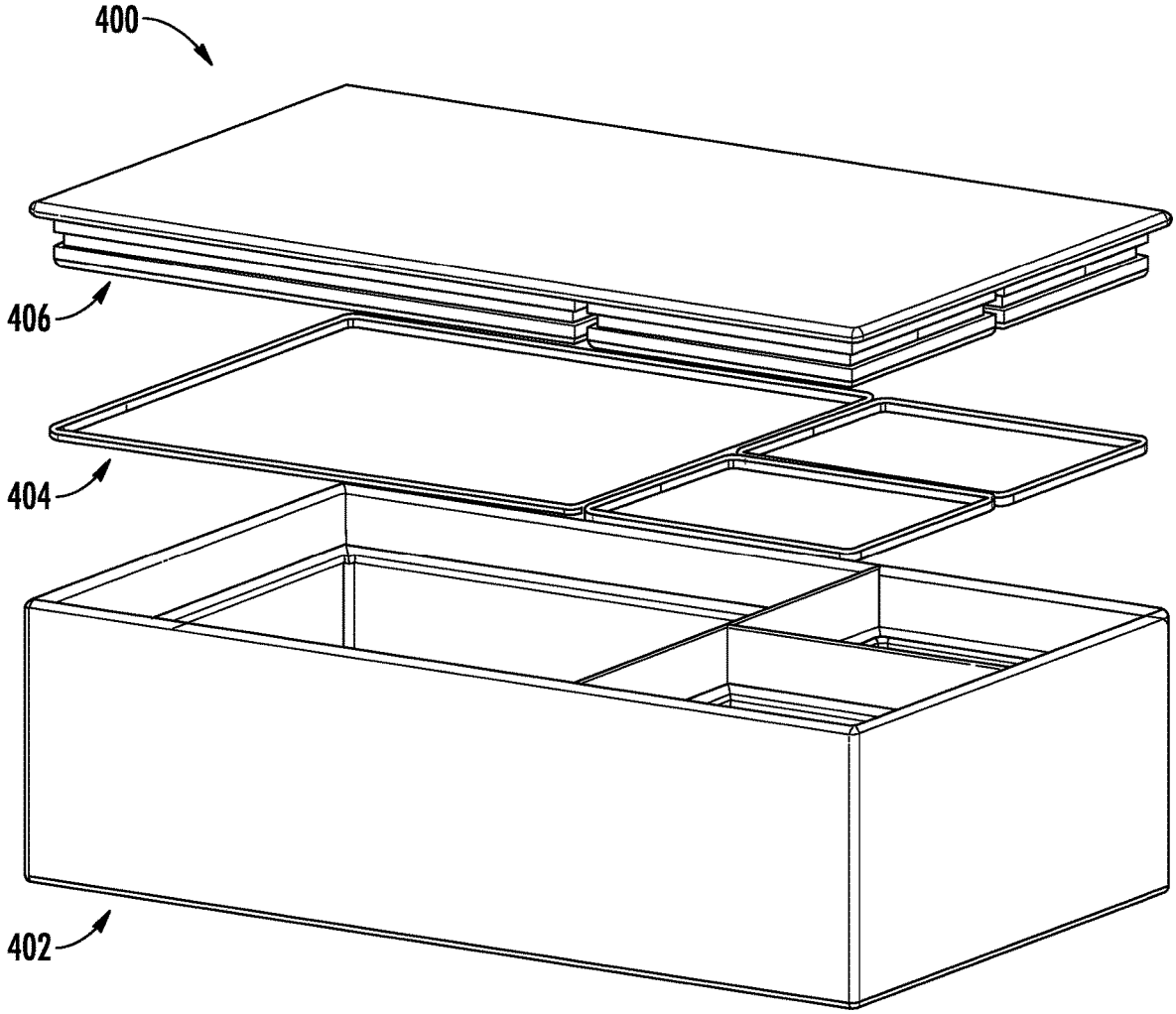
FIG. 4 illustrates an exploded view of a container having thermally insulated compartments.

FIG. 4 illustrates an exploded view of a container 400 in accordance with the present technology. Container 400 can include a base 402 having an interior volume that is divided into two or more compartments. Base 402 can have exterior walls and interior walls that are thermally insulated, as described in connection with the above-referenced figures.

Container 400 can also include a gasket 404 and a removable cover 406. Gasket 404 can be installed along the perimeter of cover 406 and along interior channels that coincide with partitions in the interior of base 402. Gasket 404 can be a single gasket having the shape depicted or it can be several gaskets corresponding to the various compartments within base 402. In some embodiments, cover 406 can include a groove that facilitates installation of gasket 404.

Figure 5:
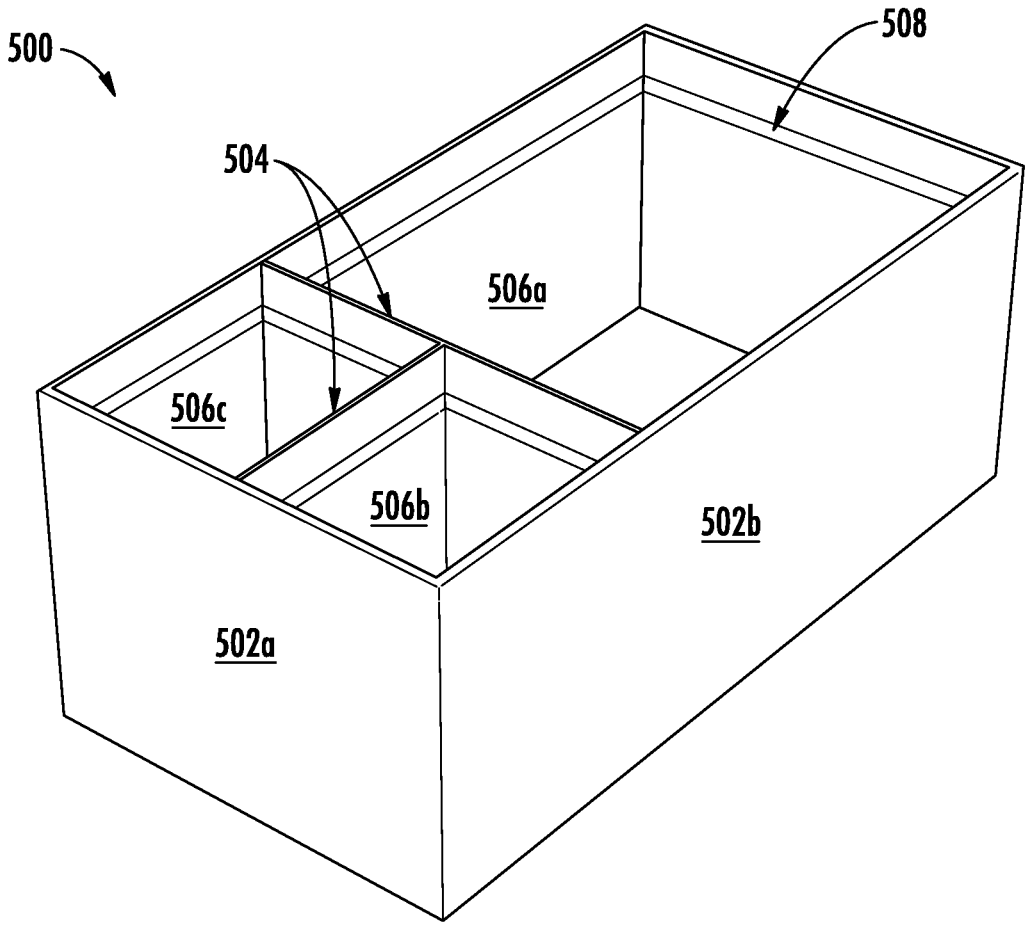
FIG. 5 illustrates another perspective view of a container having thermally insulated compartments.

FIG. 5 illustrates a perspective view of a container 500 in accordance with the present technology. Container 500 can have one or more sidewalls 502*a*, 502*b*, and a bottom surface that define an interior volume. As disclosed above, sidewalls 502*a*, 502*b* can have thermal and/or radiant energy transmission deterrence properties designed to maintain the temperature of items placed in the interior volume of container 500, whether elevated or reduced in relation to an ambient temperature external to the container 500.

The interior volume of container 500 can be divided into one or more interior compartments 506*a*, 506*b*, 506*c* by one or more interior walls 504. Interior walls 504 can have thermal and/or radiant energy transmission deterrence properties designed to provide thermal insulation between interior compartments 506*a*, 506*b*, and 506*c*. Thermal insulation provided by interior walls 504 can allow each interior compartment 506*a*, 506*b*, and 506*c* to maintain the temperature of items placed within the respective interior compartment, whether that temperature is elevated or reduced in relation to the temperature of an item placed in an adjacent interior compartment.

Sidewalls 502*a*, 502*b* and interior walls 504 can each include protrusion 508 that extends inwardly to container 500. Protrusion 508 can be used to form a ledge or ridge along the interior perimeter of each of the compartments within container 500 which can engage with or otherwise support a lid or cover (not illustrated).

Figure 6:
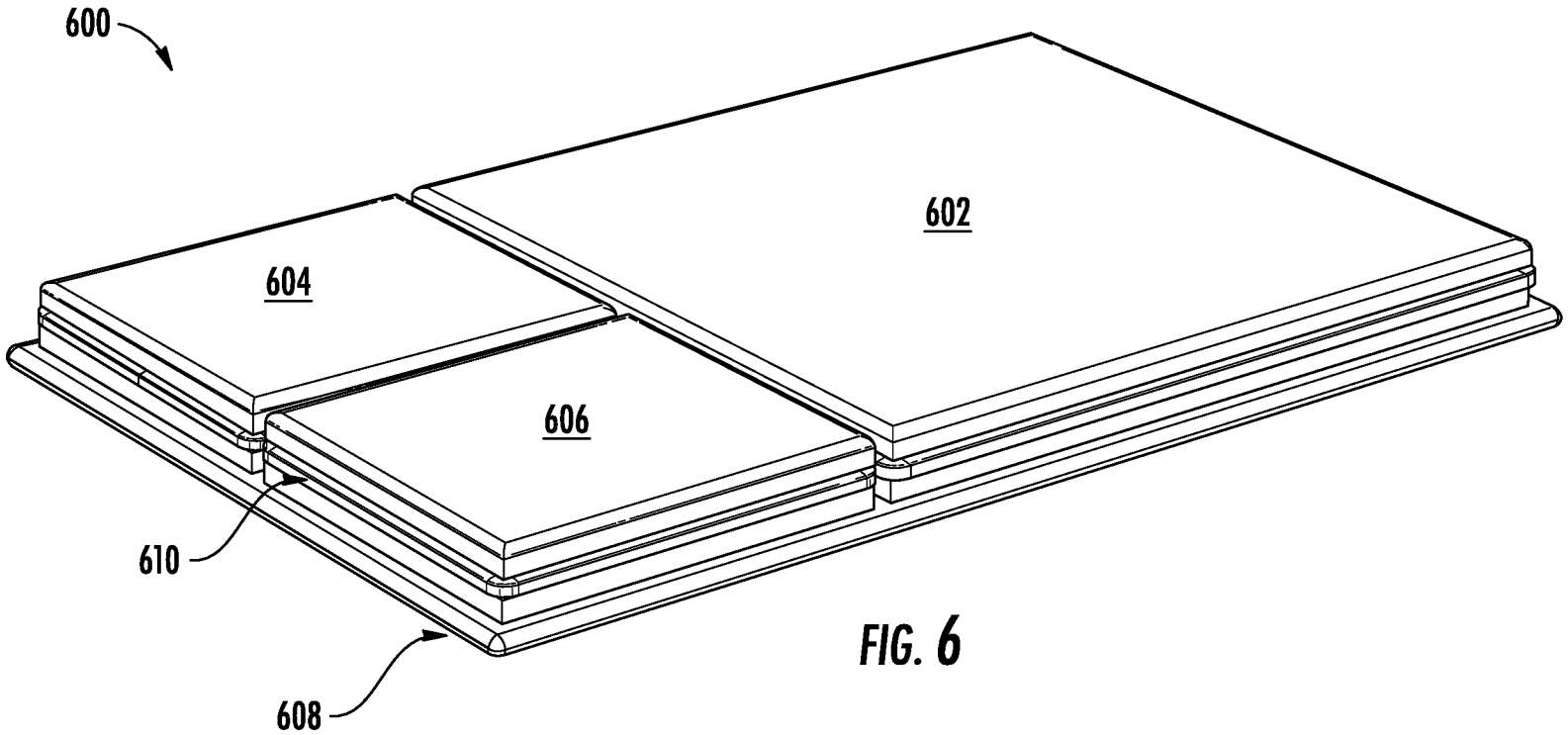
FIG. 6 illustrates a perspective view of a lid for a container having thermally insulated compartments.

FIG. 6 illustrates a perspective view of a lid 600 in accordance with the present technology. Lid 600 can include one or more compartment zones 602, 604, 606 that project from a substantially planar surface 608. Each of compartment zones 602, 604, 606 can correspond to a compartment inside of a container as described above. That is, when cover 600 is attached to its container, each of compartment zones 602, 604, 606 can cover and insulate a respective compartment within the container.

Lid 600 can also include a gasket 610 that is installed along the perimeter of lid 600 as well as the perimeter of each compartment zone 602, 604, 606. In some embodiments, lid 600 can include one or more grooves that facilitate installation of gasket 610. The grooves can be formed along the outside of each of the compartment zones and extend between the zones along the channels in between the zones, such as the channel between compartment zone 604 and compartment zone 606.

Lid 600 can be formed from any material suitable for providing thermal insulation. For example, lid 600 can be constructed from metal or a metal alloy such as stainless steel, plastic materials, or a combination thereof. Lid 600 may also include portions made of foam, rubber, or some other resilient material to facilitate a secure fit and to easily engage/disengage with a container bottom.

Figure 7:
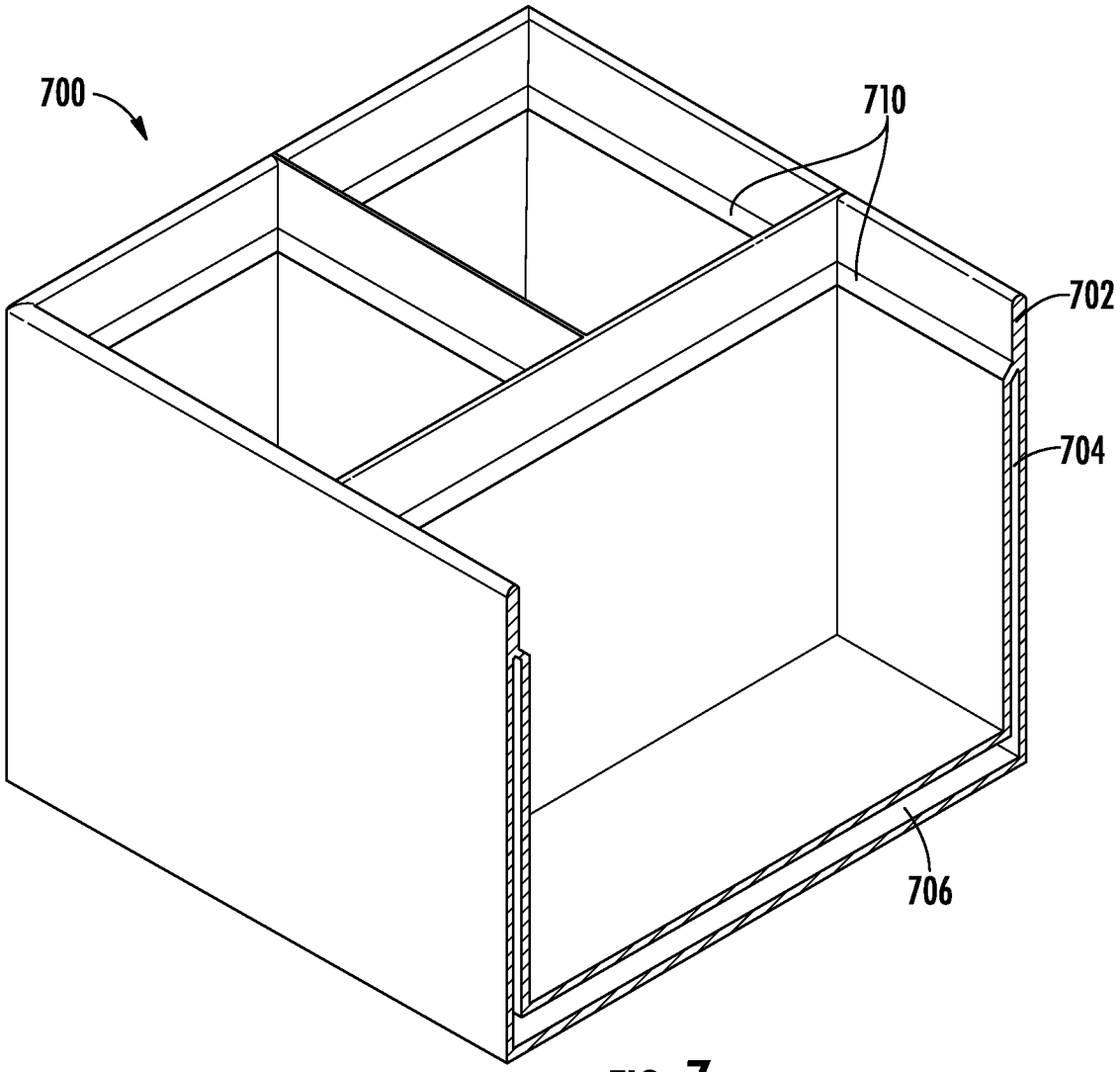
FIG. 7 illustrates another cross-sectional view of a container having thermally insulated compartments.

FIG. 7 illustrates a cross-sectional view of container 700 in accordance with the present technology. Container 700 can include a double-wall vacuum insulated barrier 704, 706 that provides thermal insulation to the interior volume of container 700. In some embodiments, the double-wall barrier 704 can extend up to the height of a ledge or protrusion 710.

Protrusion 710 can be used to form a ledge or support member that mates with a lid or cover such as, for example, the cover illustrated in FIG. 6 herein. In some embodiments, the sidewall portion of container 700 that extends above protrusion 710 can be a solid barrier 702.

Having thus described the invention of the present application in detail and by reference to embodiments thereof, it will be apparent that modifications and variations are possible without departing from the scope of the invention defined in the appended claims as follows.

We claim:

1. A container comprising:

a container bottom having at least one sidewall and a bottom wall defining an interior volume that is divided into a plurality of compartments by at least one interior wall, wherein each of the plurality of compartments has an open side opposite the bottom wall, wherein each of the at least one internal wall comprises a continuous permanently sealed double-wall thermally insulated cavity within the outer walls and dividing walls that prevents heat transfer between the plurality of compartments:

a lid configured to engage with the container bottom, wherein each of the plurality of compartments are accessible through the open side when the lid is disengaged from the container bottom and enclosed when the lid is engaged with the container bottom, the lid having an upper outer surface and a lower inner surface, wherein the lower inner surface includes a plurality of projections corresponding to each of the plurality of compartments in the container bottom, the plurality of projections configured to engage each side of the double-wall thermally insulated barrier of each of the interior walls to prevent heat transfer between the plurality of compartments and forming a channel there between, and wherein the lid comprises a permanently sealed double-wall thermally insulated barrier; and a gasket seal disposed along a perimeter of the lid.

2. The container from claim 1, wherein the double-wall thermally insulated barrier comprises a double-wall vacuum insulated barrier.

3. The container from claim 1, wherein the double-wall thermally insulated barrier comprises a double-wall barrier infused with polyurethane foam.

4. The container from claim 1, wherein the gasket seal is disposed along each of the one or more channels between the plurality of projections.

5. The container from claim 1, wherein the perimeter of the lid comprises a groove for receiving the gasket seal.

6. The container from claim 1, wherein the at least one sidewall comprises a double-wall vacuum insulated barrier.

7. The container from claim 1, comprising at least on protrusion extending from the at least one sidewall to the interior volume of the container bottom, wherein the at least one protrusion is configured to mate with the lower inner surface of the lid.

8. The container from claim 1, wherein the upper outer surface of the lid substantially corresponds with dimensions of the bottom wall.

9. A container comprising:

a container bottom having at least one sidewall and a bottom wall defining an interior volume that is divided into a plurality of compartments by at least one interior wall, wherein each of the plurality of compartments has an open side opposite the bottom wall, wherein at least one interior wall comprises two continuous permanently sealed double-wall thermally insulated cavities adjacent to and contacting each other that prevents heat transfer between the plurality of compartments a lid configured to engage with the container bottom, wherein each of the plurality of compartments are accessible through the open side when the lid is disengaged from the container bottom and enclosed when the lid is engaged with the container bottom, the lid having an upper outer surface and a lower inner surface, wherein the lower inner surface includes a plurality of projections corresponding to each of the plurality of compartments in the container bottom, the plurality of projections configured to engage each side of each of the interior walls to prevent heat transfer between the plurality of compartments and forming a channel there between, and wherein the lid comprises a permanently sealed double-wall thermally insulated barrier; and a gasket seal disposed along a perimeter of the lid.

10. The container from claim 9, wherein the double-wall thermally insulated barrier comprises a double-wall vacuum insulated barrier.

11. The container from claim 9, wherein the double-wall thermally insulated barrier comprises a double-wall barrier infused with polyurethane foam.

12. The container from claim 9, wherein the gasket seal is disposed along each of the one or more channels between the plurality of projections.

13. The container from claim 9, wherein the perimeter of the lid comprises a groove for receiving the gasket seal.

14. The container from claim 9, wherein the at least one sidewall comprises a double-wall vacuum insulated barrier.

15. The container from claim 9, comprising at least on protrusion extending from the at least one sidewall to the interior volume of the container bottom, wherein the at least one protrusion is configured to mate with the lower inner surface of the lid.

16. The container from claim 9, wherein the upper outer surface of the lid substantially corresponds with dimensions of the bottom wall.

* * * * *